United States Patent [19]

Mitani et al.

[11] Patent Number: 4,660,618

[45] Date of Patent: Apr. 28, 1987

[54] FLOW STOP CONTROL METHOD AND APPARATUS FOR CASTING WITHDRAWAL CONTROL OF HORIZONTAL CONTINUOUS CASTING MACHINE

[75] Inventors: Kazuo Mitani, Kawasaki; Yoshiharu Hirota; Shinobu Kumagai, both of Yokohama; Shigeki Komori, Kawasaki; Masahiro Tsuru, Yokohama, all of Japan

[73] Assignee: Nippon Kokan Kabushiki Kaisha, Tokyo, Japan

[21] Appl. No.: 764,131

[22] Filed: Aug. 9, 1985

[30] Foreign Application Priority Data

Aug. 9, 1984 [JP] Japan ..... 59-165600

[51] Int. Cl.[4] ..... B22D 11/20

[52] U.S. Cl. ..... 164/454; 164/413; 164/440; 164/490; 164/478; 164/416

[58] Field of Search ..... 164/454, 413, 490, 440, 164/478, 416

[56] References Cited

FOREIGN PATENT DOCUMENTS 56-84159 7/1981 Japan ..... 164/413

*Primary Examiner*—Kuang Y. Lin

*Attorney, Agent, or Firm*—Fleit, Jacobson, Cohn & Price

[57] ABSTRACT

In a horizontal continuous casting machine having a casting withdrawing cycle consisting of withdrawing, stopping and push-back periods, a method of controlling the stop of the flow of a casting during the stopping period of the withdrawing cycle so as to stop the flow of the casting within a predetermined period. The desired braking torque is calculated in consideration of the load variations due to the casting condition of the horizontal continuous casting machine and the braking torque is applied to the pinch roll shafts upon the termination of the withdrawing period thereby effecting the stop of the flow of the casting during the stopping period within the predetermined time.

8 Claims, 5 Drawing Figures

WITHDRAWING SPEED
Vo
TIME
td
t1
t2
t3

DRIVING HYDRAULIC MOTO INTERNAL PRESSURE
ΔPo
BRAKING HYDRAULIC MOTOR INTERNAL PRESSURE CONTROL
DRIVING HYDRAULIC MOTOR INTERNAL PRESSURE CONTROL
TIME
ΔP'
t1
t2
t3

BRAKING HYDRAULIC MOTOR INTERNAL PRESSURE
ΔPb
TIME
t1
td

FLOW STOP CONTROL METHOD AND APPARATUS FOR CASTING WITHDRAWAL CONTROL OF HORIZONTAL CONTINUOUS CASTING MACHINE

BACKGROUND OF THE INVENTION

1. Field of the Invention

The present invention relates to a flow stop control method for ensuring the desired stop condition in a casting withdrawal control of a horizontal continuous casting machine.

2. Description of the Prior Art

In known horizontal continuous casting machines, the rotation of a driving hydraulic motor which is restricted by a servo valve is transmitted to the shafts of pinch rolls through a group of gears and the pinch rolls are driven by the rotation of the pinch roll shafts thereby withdrawing the casting. This withdrawal of the casting is effected through a withdrawing cycle, consisting of withdrawing, stopping and push-back periods, and during the stopping period, the flow or run of the casting is stopped by restricting the flow rate of a braking hydraulic motor connected to the gear train through a throttle valve and thereby applying a braking torque in the withdrawing direction of the pinch rolls.

Since the application of the braking torque in the withdrawing direction of the pinch rolls by the braking hydraulic motor is effected on the basis of its internal pressure restricted by the throttle valve, it is difficult to apply any given constant braking torque. In other words, the braking torque, due to the braking hydraulic motor internal pressure, is varied by the rotation speed of the pinch rolls. Therefore, the adjustment of the braking torque through the opening adjustment of the throttle valve must inevitably have recourse to experiments.

Also, this unstable braking torque is applied even during the withdrawing period and the push-back period other than during the casting flow stop in the stopping period of the withdrawing cycle the unstable braking torque is contradictory action, due to the flow stopping action during the stopping period and the load torque during the withdrawing period, and the withdrawing waveform tends to become unstable. In other words, the unstable braking torque is applied even during the withdrawing period and the push-back period after the casting flow stop in the stopping period of the withdrawing cycle. Therefore, the braking torque functions as casting flow stop during the stopping period but it also functions as load torque during the withdrawing period. When the braking torque functions as load torque, the power for withdrawing the casting inevitably varies and the withdrawing waveform tends to become unstable.

Also, while, in the horizontal continuous casting machine, the load variations (the variations of the friction and the load inertia) due to the casting condition exist to a degree that cannot be disregarded, the above-mentioned conventional flow stop control method gives no consideration to the load variations and the control is effected by use of the unstable braking torque thus making it difficult to ensure a stable stop condition. There is another disadvantage that the stopping period in the withdrawing cycle is the period of time required for the growth of a shell to be newly formed so that if this stopping period is not stably ensured, the growth of the shell is incomplete and a rupture (breaking apart) of the shell occurs during the next withdrawing step thus making it difficult to ensure the stable casting operation.

SUMMARY OF THE INVENTION

It is the primary object of the present invention to provide an improved method of controlling the stop of the flow or run of a casting, which overcomes the foregoing deficiencies of the conventional casting flow stop control method and which prevents the flow of a casting that increases with an increase in the load inertia thereby ensuring the desired stable stop condition.

To accomplish this object, in accordance with the invention there is thus provided a control method in which a braking torque is calculated in consideration of the inertial loads varying in dependence on the casting condition and the braking torque is applied to the pinch roll shafts thereby effecting the flow stop of a casting during the stopping period of a casting withdrawing cycle within a predetermined period of time.

In accordance with an embodiment of the invention, a casting flow stop control method applies to the pinch roll shafts a braking torque produced by controlling the internal pressure of a braking hydraulic motor through a high-speed pressure control loop.

In accordance with the invention, due to the fact that a desired value to be controlled is obtained in consideration of the load variations (the variations of the friction and the load inertia) due to the casting condition and also the length of the casting is taken into consideration, as compared with the conventional method which applies a braking torque that is determined experimentally and unstable, a stable stop condition is ensured throughout the casting operation and therefore the automation of the casting essential for the production equipment can also be effected in the flow stop control.

Further, any given constant breaking torque can be applied and thus the control can be effected quantitatively as compared with the conventional control method.

Still further, due to the fact that the braking torque is applied only during the stopping period requiring the braking torque, no ill effect is caused on the rise of the withdrawing speed, etc., thus making it possible to effect the withdrawal of the casting stably.

The above and other objects, features and advantages of the invention will become more clear from the following description taken in conjunction with the accompanying drawings.

DETAILED DESCRIPTION OF THE PREFERRED EMBODIMENTS

Figure 1:
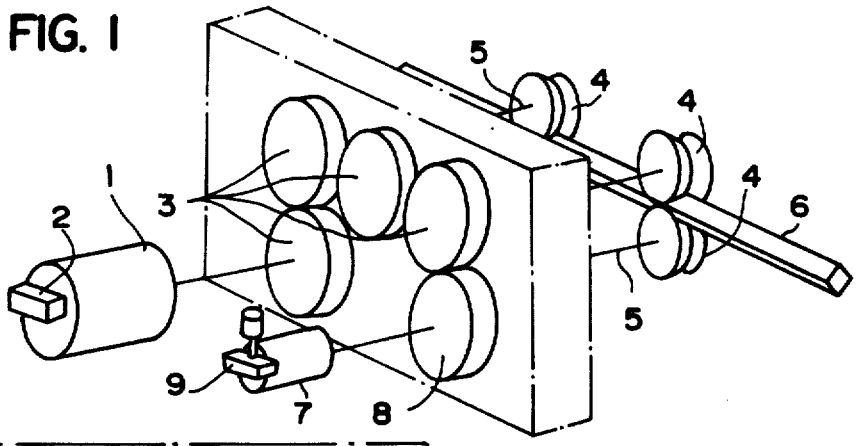
FIG. 1 is a schematic diagram showing the construction of a horizontal continuous casting machine.

FIG. 1 is a schematic diagram showing the construction of a horizontal continuous casting machine. In the Figure, numeral 1 designates a driving hydraulic motor including a servo valve 2, which is connected to pinch roll shafts 5 of pinch rolls 4 through a gear train 3 and the pinch rolls 4 are driven by the rotation of the driving hydraulic motor 1 controlled by the servo valve 2 thereby withdrawing a billet 6. Numeral 7 designates a braking hydraulic motor connected to the gear train 3 through a gear 8 and the flow rate of the braking hydraulic motor 7 is restricted by a throttle valve 9 thereby applying a braking torque in the withdrawing direction of the pinch rolls 4.

Figures 3A, 3B, 3C:
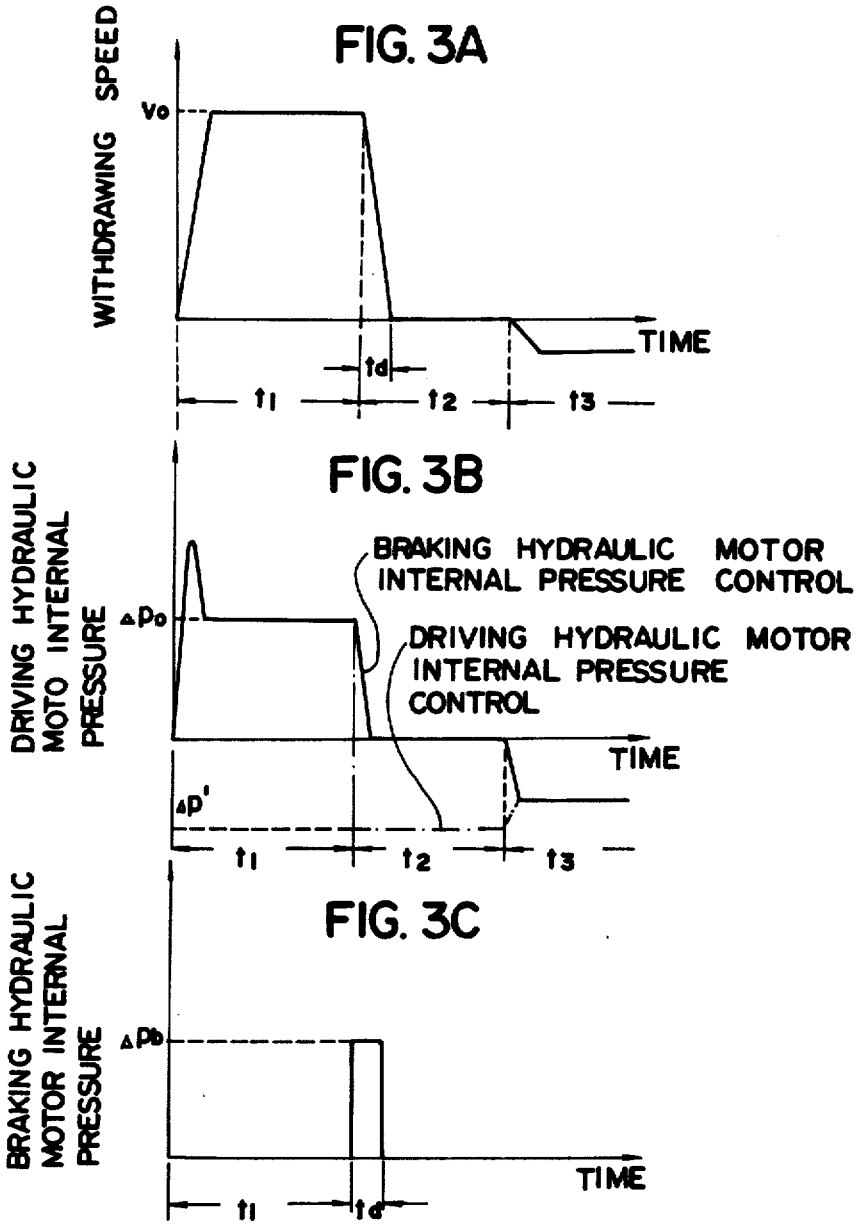
FIG. 3A shows a withdrawing speed characteristic of the machine during its withdrawing cycle.
FIG. 3B shows an internal pressure characteristic of the driving hydraulic motor.
FIG. 3C shows an internal pressure characteristic of the braking hydraulic motor.

The withdrawing cycle of the horizontal continuous casting machine consists of a withdrawing period $t_1$, a stopping period $t_2$ and a push-back period $t_3$ as shown in FIG. 3A and during the withdrawing period $t_1$ the withdrawal of a casting is effected in accordance with the final withdrawing speed $V_o$ shown in FIG. 3A and the pressure difference between the inlet and outlet sides of the driving hydraulic motor or the final withdrawing pressure ΔPo shown in FIG. 3B. The required braking torque T for holding the flow time of the casting within a predetermined flow time td is given by the following equation in accordance with the final withdrawing speed $V_o$ and the final withdrawing pressure ΔPo.

$$T = -J\cdot(V_o/r_p)\cdot td + Dm(1-Cf)\cdot\Delta Po \quad (1)$$

where $$J = J_1 + (Mr_p2/g)\cdot L_t$$

$J_1$ : total inertial moment (Kg·cm·sec²) of driving hydraulic motor, braking hydraulic motor, pinch rolls, roll shafts and gears
M : billet unit weight (kg/cm)
$r_p$ : pinch roll contact radius (cm)
g : gravitational acceleration(cm/sec²)
td : preset flow time (sec)
Dm : transfer volume of oil per radian of driving hydraulic motor shaft rotation angle (cc/rad)
(1−Cf) : driving hydraulic motor torque efficiency
Lt : present casting length (cm)

The braking torque T shown by the equation (1) represents the difference value between the negative acceleration torque that must be applied to the billet and the casting loss torque such as the frictional torque and in principle the flow of the billet can be stopped within the preset flow time td by the application of the braking torque T during the decleration.

The flow stop control method utilizing the braking torque T calculated in consideration of the inertial loads as shown by the equation (1) will now be described with reference to FIG. 2.

Figure 2:
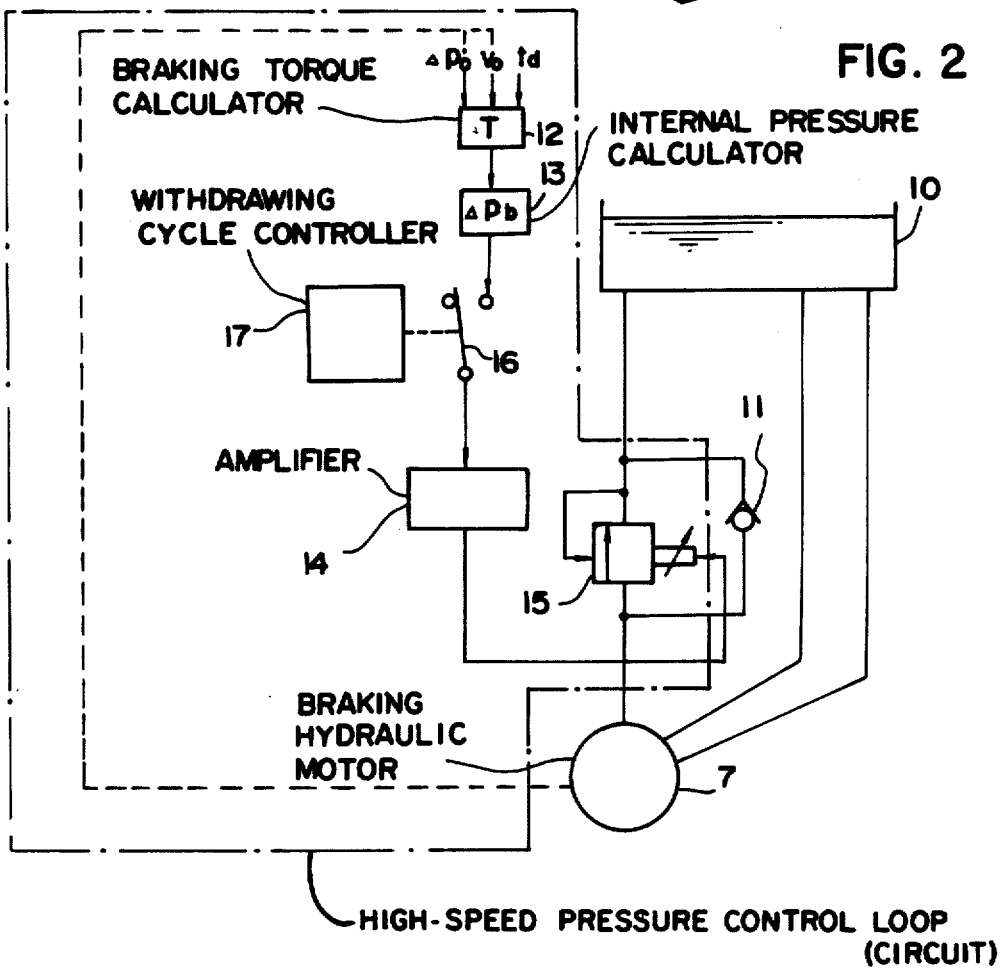
FIG. 2 is a schematic block diagram showing the construction of a control system for braking hydraulic motor internal pressure control purpose.

FIG. 2 shows the construction of a control system used with the invention, in which numeral 7 designates the braking hydraulic motor shown in FIG. 1 and an oil tank 10. The braking torque T shown by the equation (1) is calculated by braking torque calculator 12 in accordance with the final withdrawing speed $V_o$ and the final withdrawing pressure ΔPo during the withdrawing period $t_1$ of the withdrawing cycle and the preset flow time td and braking hydraulic motor internal pressure calculator 13 calculates a braking hydraulic motor internal pressure ΔPb from the calculated braking torque T. The braking hydraulic motor internal pressure ΔPb is calculated from the following equation in accordance with the braking torque T.

$$\Delta Pb = T/Dmb(1 - Cfb) \quad (2)$$
$$= (-J\cdot(V_o/r_p)\cdot td + Dm(1 - Cf)\cdot\Delta Po)/Dmb(1 - Cfb)$$

where

Dmb: transfer volume of oil per radian of braking hydraulic motor shaft rotation angle(cc/rad)
(1−Cfb): braking hydraulic motor torque efficiency.

The rest is the same as in the equation (1).

Then, the braking hydraulic motor internal pressure ΔPb is applied to an amplifier 14 through a change-over switch 16 so that as for example, the opening of a proportional electromagnetic control valve 15 connected between the braking hydraulic motor 7 and the oil tank 10 is varied by the output signal from the amplifier 14 and the internal pressure of the braking hydraulic motor 7 is controlled. The change-over switch 16 is responsive to the end of withdrawing period $t_1$ signal from withdrawing cycle control means 17 to apply the braking hydraulic motor internal pressure ΔPb signal to the amplifier 14. Also, in this case, a check valve 11 is connected in parallel with the proportional control valve 15 to prevent the pressure from being applied to the push-back side.

FIGS. 3A, 3B and 3C show various characteristics during the withdrawing cycle according to the flow stop control method which controls the internal pressure of the braking hydraulic motor through the high-speed pressure control loop. FIG. 3A shows the withdrawing speed characteristic, FIG. 3B the driving hydraulic motor internal pressure characteristic and FIG. 3C the braking hydraulic motor internal pressure characteristic.

As shown in FIG. 3A, after the termination of the withdrawing period $t_1$ the braking hydraulic motor internal pressure hydraulic motor 7 as shown in FIG. 3C and the desired braking torque is applied to the pinch roll shafts. By virtue of this braking torque, the final withdrawing speed $V_o$ and the final withdrawing pressure ΔPo are decreased as shown by the solid lines in FIGS. 3(*a*) and 3(*b*), respectively, and thus the withdrawing speed is reduced to zero within the preset flow time td. The withdrawing cycle control means 17 detects the reduction of the withdrawing speed to zero so that the change-over switch 16 is switched and the braking hydraulic motor internal pressure ΔPb is reduced to zero.

While the above-described control method includes the braking hydraulic motor flow stop control system, the similar function can also be performed by providing a flow stop control system in which the braking hydraulic motor is not used and the driving hydraulic motor itself applies a negative acceleration torque (braking torque) to the pinch roll shafts.

The required driving hydraulic motor internal pressure ΔP' for causing the driving hydraulic motor to generate the desired negative acceleration torque (braking torque) T is given by the following in accordance with the equation (1)

$$P' = T/Dm(1 - Cf) \quad (3)$$
$$= (-J(V_o/rp)td + Dm(1 - Cf)\Delta Po)/Dm(1 - Cf)$$

By applying the internal pressure ΔP' to the driving hydraulic motor upon the termination of the withdrawing period of the withdrawing cycle as shown by the broken line in FIG. 3B, it is possible to apply the negative acceleration torque T to the pinch roll shafts and thereby reduce the withdrawing speed to zero within the preset withdrawing time td. It is to be noted that the negative acceleration torque produced by the driving hydraulic motor internal pressure $\Delta P'$ is applied only during the stopping period $t_2$ in the withdrawing cycle.

What is claimed is:

1. A horizontal continuous casting method of controlling the stop of the flow of a casting process which includes a withdrawing cycle for withdrawing a casting including casting withdrawing, stopping and push-back periods, the stop of flow occurring during said stopping period of said withdrawing cycle comprising the steps of: calculating a braking torque based upon inertial loads varying with a casting condition during said casting process; and applying braking torque to said casting thereby accomplishing the stop of the flow of said casting during said stopping period within a predetermined time.

2. A method for controlling the stop of the flow of a casting during a stopping period of a withdrawing cycle consisting of casting withdrawing, stopping and push-back periods in a horizontal continuous casting method, comprising the steps of: calculating a braking torque in consideration of inertial loads; and applying said braking torque to said casting thereby accomplishing the stop of the flow of said casting during said stopping period within a predetermined time.

3. An apparatus for controlling the withdrawing of a casting for a horizontal continuous casting machine including:

(a) a plurality of pinch rolls for withdrawing a casting during the withdrawing period of a withdrawing cycle and pushing it back during a push-back period of said withdrawing cycle;

(b) a driving hydraulic motor for driving said pinch rolls which is connected to the shafts of pinch rolls (c) calculating means for calculating brake torque;

(d) means for inputting values of inertial loads to said calculating means; and period of said withdrawing cycle shall take place within a preset period of time.

4. An apparatus according to claim 3 wherein said braking torque is applied by controlling an internal pressure of a braking hydraulic motor that is said braking means through a high-speed pressure control loop.

5. An apparatus according to claim 4, wherein said high-speed pressure control loop comprises:

withdrawing cycle control means for establishing and controlling said casting withdrawing cycle;

braking torque computing means for computing a braking torque T in accordance with a final withdrawing speed Vo and a final withdrawing pressure $\Delta Po$ in said casting with drawing period established by said casting withdrawing cycle control means and a predetermined flow time td;

braking hydraulic motor internal pressure computing means for generating a braking hydraulic motor internal pressure signal $\Delta Pb$ in accordance with said braking toque T computed by said braking torque computing means;

a change-over switch responsive to an end of withdrawing period signal from said withdrawing cycle control means to apply said braking hydraulic motor internal pressure signal $\Delta Pb$ computed by said braking hydraulic motor internal pressure computing means to an amplifier; and a control valve responsive to an output signal from said amplifier to control the internal pressure of said braking hydraulic motor.

6. An apparatus according to claim 3, wherein said braking torque is applied by controlling a push-back internal pressure of said driving hydraulic motor through a high-speed pressure control loop.

7. An apparatus according to claim 6, wherein said high-speed pressure control loop comprises:

withdrawing cycle control means for establishing and controlling said casting withdrawing cycle;

braking torque computing means for computing a braking torque T in accordance with a final withdrawing speed $V_o$ and a final withdrawing pressure $\Delta Po$ in said casting withdrawing period established by said withdrawing cycle control means and a predetermined flow time td;

driving hydraulic motor internal pressure computing means for generating a driving hydraulic motor internal pressure signal $\Delta P'$ in accordance with said braking torque T computed by said braking torque computing means;

a change-over switch responsive to an end of withdrawing period signal from said withdrawing cycle control means to apply said driving hydraulic motor interval pressure signal $\Delta P'$ generated from said driving hydraulic motor internal pressure computing means to an amplifier; and a control valve responsive to an output signal from said amplifier to control the internal pressure of said driving hydraulic motor.

8. An apparatus according to claim 7 wherein said inertial load includes the inertial moments of said driving hydraulic motor, said braking hydraulic motor, said pinch rolls, pinch roll shafts and gear train and an inertial moment of the casting billet.

* * * * *

UNITED STATES PATENT AND TRADEMARK OFFICE

CERTIFICATE OF CORRECTION

PATENT NO. : 4,660,618

DATED : April 28, 1987

INVENTOR(S) : Mitani et al.

It is certified that error appears in the above-identified patent and that said Letters Patent is hereby corrected as shown below:

Column 5, line 38, after "rolls" insert --through a gear train;--; and line 41, after "and" insert the following as the beginning of a new paragraph:

--(e) braking means for applying braking torque corresponding to the inertial load to said pinch rolls so that a stop of the flow of said casting during a stopping--.

Signed and Sealed this

Twenty-eighth Day of June, 1988

*Attest:*

DONALD J. QUIGG

*Attesting Officer*

*Commissioner of Patents and Trademarks*